US005647955A

United States Patent [19]

Vaistomaa et al.

[11] Patent Number: 5,647,955

[45] Date of Patent: Jul. 15, 1997

[54] METHOD OF REDUCING SCALING OF HEAT TRANSFER SURFACES IN AN EVAPORATION PLANT OF A SULPHATE CELLULOSE MILL

[75] Inventors: Jukka Vaistomaa, Pori; Jarmo Kaila, Helsinki; Jouko Rikkinen, Kangasala; Matti Knuutila, Pori, all of Finland

[73] Assignee: Tampella Power Oy, Tampere, Finland

[21] Appl. No.: 543,060

[22] Filed: Oct. 13, 1995

[30] Foreign Application Priority Data

Oct. 24, 1994 [FI] Finland ..... 944996

[51] Int. Cl.[6] ..... D21C 11/04

[52] U.S. Cl. ..... 162/30.11; 162/48

[58] Field of Search ..... 162/30.11, 48; 159/47.3

[56] References Cited

U.S. PATENT DOCUMENTS 4,909,899 3/1990 Kuskila ..... 159/47.3
5,112,441 5/1992 Ruohola et al. ..... 159/47.3

FOREIGN PATENT DOCUMENTS 82951 5/1986 Finland .
503419 12/1978 U.S.S.R. .

OTHER PUBLICATIONS

Gary A. Smook, "Handbook for Pulp & Paper Tech", 2nd Edition, 1992, pp. 133–140.

Offical Action issued in the Finnish priority application No. 944996 (dated 16, Jun. 1995).

*Robert. Hedrick and John S. Kent*— "Crystallizing Sodium Salts From Black Liquor"; Dec. 1992 Tappi Journal (pp. 107–111).

*Primary Examiner*—Donald E. Czaja
*Assistant Examiner*—Dean T. Nguyen
*Attorney, Agent, or Firm*—Dressler, Rockey, Milnamow & Katz, Ltd.

[57] ABSTRACT

Method of reducing scaling of heat transfer surfaces in an evaporation plant of a sulphate cellulose mill when sulphate cellulose is manufactured. In the method, ash to be fed into black liquor is mixed thereto after soap separation when the dry solids content of the black liquor is so low that sodium sulphate and other soluble salts contained in the ash dissolve in the black liquor completely.

5 Claims, 1 Drawing Sheet

METHOD OF REDUCING SCALING OF HEAT TRANSFER SURFACES IN AN EVAPORATION PLANT OF A SULPHATE CELLULOSE MILL

BACKGROUND OF THE INVENTION

1. Field of the Invention

The invention relates to a method of reducing scaling of heat transfer surfaces in an evaporation plant of a sulphate cellulose mill when sulphate cellulose is manufactured by a process in which ash containing sodium sulphate and produced in a combustion process of a soda recovery boiler is added to black liquor to be burned, before the last evaporation stage of the black liquor.

2. The Prior Art

In a sulphate cellulose process, like in all chemical processes, losses of various chemicals occur either in gaseous or liquid form. In the sulphate cellulose process, gaseous losses occur for instance in cooking plant and evaporation plant with exhaust steam, i.e. secondary steams, and in soda recovery boiler with flue gases. Liquid losses occur in washing plant, for example, from where chemicals flow out with wash water. For the maintenance of the operation of the process, the losses of chemicals shall be replaced by feeding new chemicals to the process at a suitable stage. It is especially important to keep the sulphur/sodium balance of the process at a suitable level. This is considerably impeded by the fact that chemical losses are rather different in different factories, and accordingly, it is not possible to define generally applicably an unequivocal addition of chemicals.

Sodium and sulphur losses in the chemical recovery loop are generally compensated for by adding sodium sulphate obtained from ash hoppers and an electrostatic filter of the soda recovery boiler to strong black liquor before it is burned. It is then possible to add also extra bought sodium sulphate, if the use of ash is not enough for the maintenance of equilibrium. A separate so-called make-up chemical is needed less in the present technique when closed chemical recovery loops are introduced more than before, in which various losses of chemicals are recovered and recycled in the process.

U.S. Pat. No. 4,909,899 discloses a solution in which ash is added to liquor in the chemical recovery loop after the last evaporation stage just before the liquor is fed into a soda recovery boiler. On the other hand, U.S. Pat. No. 5,112,441 discloses how ash and make-up chemicals are fed either directly into a combustion chamber of a soda recovery boiler or into a separate mixing tank, which is before the last additional concentration stage. This publication concerns a solution in which black liquor is burned at a high dry solids content of about 80% or even more. One object of the prior art technique has been that ash is added to black liquor before the last evaporation stage at a dry solids content of about 65%, whereby so-called mother crystals are produced in the black liquor before its final concentration. The mother crystals then act as crystal nuclei in the black liquor, which leads to that crystals produced at the evaporation of black liquor stick to the mother crystals and form bigger and bigger crystals. These big crystals again pass forward with the black liquor and do not stick to the wall of an evaporator unit, due to which the last evaporator unit does not scale so easily as it would do without mother crystals.

The article "Crystallizing sodium salts from black liquor" (Hedrick, Kent, Tappi Journal, December 1992) describes crystallization of sodium sulphate and sodium carbonate contained in black liquor, whereby they together form Burkeite under certain circumstances and crystallize together with the Burkeite. The article describes the behaviour of these salts in black liquor and their crystallization and other properties from the point of view of evaporation plant. The article discusses primarily the theory of crystallization and experiments made on the basis of that theory as well as an application of the solution in connection with crystallizers.

A general drawback of the prior art technique is that the salts produced in the process tend to crystallize at different stages and to scale especially heat transfer surfaces of an evaporator. There have been problems also with the operation of the mixing tank. In circumstances when a dissolution of salts is difficult also otherwise, salts introduced as an addition are not always capable of dissolving in a desired manner, and therefore, the scaling problem is maintained. Due to this, a utilization of mother crystals is also difficult, because solid crystals do not stick to mother crystals any longer, but the salts remain as small separate crystals.

SUMMARY OF THE INVENTION

The object of this invention is to provide such a method which avoids the drawbacks of the known solutions and in consequence of which the heat transfer surfaces of an evaporator are easy to clean by a conventional wash.

The method in accordance with the invention is characterized in that the ash is added to the black liquor after soap separation at such a stage when the dry solids content of the black liquor is so low that substantially all sodium sulphate and other soluble salts contained in the ash are capable of dissolving substantially completely in the black liquor.

The essential idea of the invention is that sodium sulphate is mixed after soap separation to black liquor having a sufficiently low dry solids content in such a way that the sodium sulphate and the other soluble salts dissolve completely in the black liquor, whereby the sodium sulphate may form Burkeite together with the sodium carbonate contained in the liquor. Subsequently, the black liquor is recycled in the process after the soap separation in such a way that crystals produced do not disturb the soap separation. In fact, it has been found out unexpectedly that if ash and possible additional sodium sulphate, i.e. all make-up chemicals, are fed into the black liquor at a sufficiently early stage, they can be made to dissolve completely and to react in a desired manner so that Burkeite obtained as a reaction product is capable of crystallizing efficiently and of acting simultaneously as mother crystals at later stages so that the crystallizing salts can be made to pass by critical heat transfer surfaces and other conventionally scaling stages.

An advantage of the method in accordance with the invention is that sodium carbonate and sodium sulphate can be made to form as much Burkeite as possible, which is easy to wash off from the surface of an evaporator. A further advantage of the method of the invention is that the produced Burkeite crystals also can act as mother crystals in the last stages of the evaporation, whereby scaling of the last evaporation stages is less than before.

BRIEF DESCRIPTION OF THE DRAWINGS

The invention is described in greater detail in the attached drawing, in which.

DETAILED DESCRIPTION OF THE DRAWINGS

Figure 1:
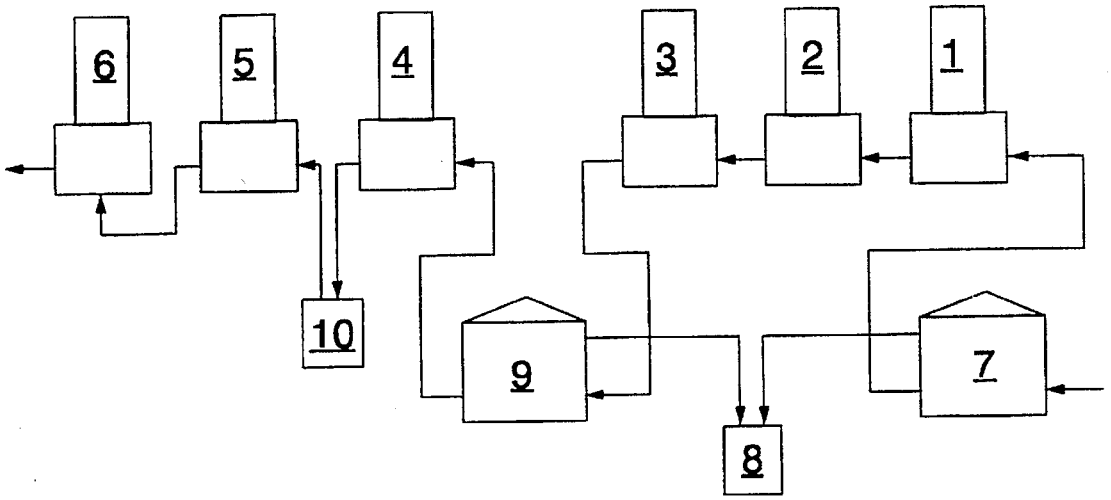
FIG. 1 shows schematically an embodiment of the method in accordance with the invention and FIG. 2 shows schematically another embodiment of the method in accordance with the invention.

FIG. 1 shows schematically an evaporation plant of a sulphate cellulose mill, the evaporation plant comprising six evaporation stages 1 to 6. Feed liquor comes into a feed liquor tank 7 of the evaporation plant, in which tank part of the soap contained in the black liquor can be separated into a soap tank 8. Subsequently, the black liquor is fed to a first evaporation stage 1, from which it is moved further after the evaporation via evaporation stages 2 and 3 into an intermediate liquor tank 9. In the intermediate liquor tank 9, the remaining soap is removed therefrom and led into the soap tank 8. From the intermediate liquor tank 9 the black liquor is led further to the following evaporation stage 4, from which the outcoming black liquor is led into a separate mixing tank 10. In the mixing tank 10, ash and possible make-up sodium sulphate are mixed into the black liquor, due to which the sodium sulphate and the chemicals contained in the ash dissolve in the black liquor. When the dry solids content increases, the dissolved sodium sulphate may then later, together with the sodium carbonate contained in the liquor, form Burkeite, which is a double salt of sodium sulphate and sodium carbonate.

The Burkeite crystals produced pass forward in the evaporation plant with the liquor as far as to the soda recovery boiler. On the way they act as crystal nuclei. If Burkeite crystals happen to stick to the walls of the evaporator, they can be removed easily in connection with a normal wash.

From the mixing tank 10 the black liquor is led further via the remaining evaporation stages 5 and 6 to be fed into the soda recovery boiler.

By feeding the ash and the required make-up sodium sulphate into the mixing tank in the manner shown in FIG. 1, the sodium sulphate can be made to dissolve in the black liquor substantially completely, since the dry solids content of the black liquor is low enough at this stage, i.e. about 30%. Completely dissolved, the sodium sulphate may together with the sodium carbonate easily form Burkeite at the crystallizing stage, whereby the sodium carbonate binds itself to the sodium sulphate and does not crystallize separately on the surface of the evaporator at later evaporation stages. Simultaneeously, the Burkeite crystals produced may act as mother crystals at the following evaporation stages, and accordingly, the crystallizing material flows more easily through the evaporator and does not tend to stick to the walls thereof. Further, the Burkeite partly crystallizing on the walls of the evaporator is easy to wash off from the evaporator by a normal wash, because Burkeite dissolves in water without difficulty.

Figure 2:
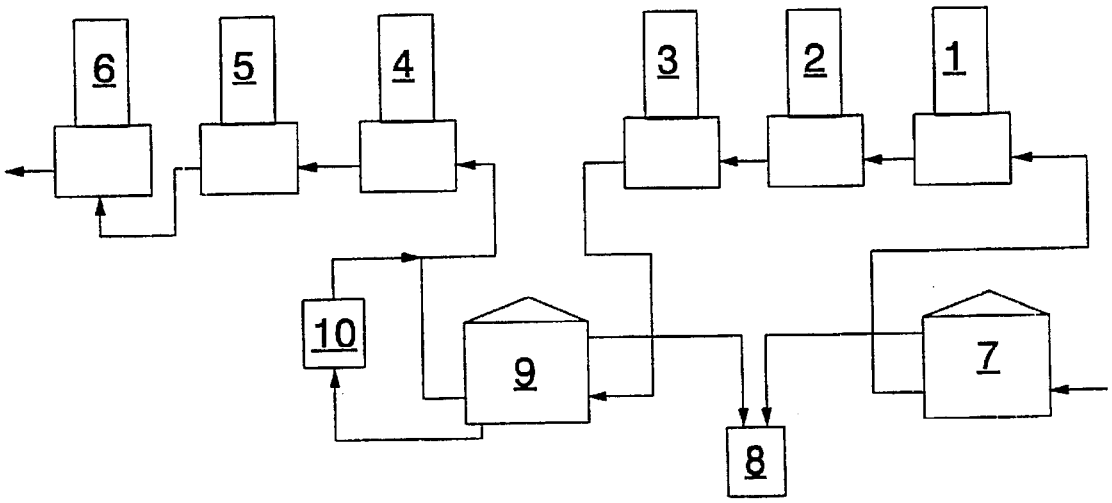

FIG. 2 shows another embodiment of the method in accordance with the invention. Numerals corresponding to FIG. 1 are used in FIG. 2. In the embodiment of FIG. 2, part of the black liquor is separated from the intermediate liquor tank 9 and led into the mixing tank 10. In this case, the dry solids content of the black liquor is about 21 to 26%, whereby part of the entire liquor circulation loop is enough for a dissolution of the salts contained in the ash to be fed into the mixing tank and the possible make-up sodium sulphate. In this case, the black liquor removed from the mixing tank 10 is mixed into the black liquor leaving the intermediate liquor tank 9 and going to the following evaporation stage 4, whereby an addition of ash and sodium sulphate does not disturb the soap separation in the intermediate liquor tank.

The method in accordance with the invention can be implemented in various manners, but the essential thing is that the ash and the possible make-up sodium sulphate aye added to black liquor the dry solids content of which is low enough and from which the soap has already been separated, so that the sodium sulphate dissolves in the black liquor as completely as possible. Another essential idea is that this black liquor is recycled after the soap separation. Burkeite obtained as a reaction product does not stick easily to the evaporator surfaces at the different stages of the evaporation plant and acts simultaneously as a mother crystal, to which the salts tending to crystallize stick and with which they thus pass through the evaporator.

We claim:

1. A method for reducing scaling of heat transfer surfaces in an evaporation plant of a sulphate cellulose mill, the method comprising the steps of:

adding ash containing sodium sulphate and other soluble salts produced in a combustion process of a soda recovery boiler to black liquor in a mixing tank after soap separation from the black liquor but prior to a final evaporation stage of the black liquor, wherein the black liquor has a sufficiently low dry solids content to allow the sodium sulphate and other soluble salts contained in the ash to dissolve completely in the black liquor, wherein the sodium sulphate dissolved in the black liquor reacts with sodium carbonate contained in the black liquor to form Burkeite that is capable of crystallizing when the dry solids content of the black liquor increases which reduces scaling of heat transfer surfaces in the evaporation plant; and evaporating and burning the ash containing black liquor.

2. The method of claim 1 wherein the ash is added to the black liquor in the mixing tank after an evaporation stage, wherein the evaporation stage is next to an intermediate liquor tank used for soap separation, and the ash containing black liquor is removed from the mixing tank and directed to a further evaporation stage.

3. The method of claim 1 further comprising the steps of removing a portion of the black liquor from an intermediate liquor tank to the mixing tank, wherein the intermediate liquor tank separates the soap from the black liquor; mixing ash into the black liquor in the mixing tank; and removing the ash containing black liquor from the mixing tank to a further evaporation stage.

4. The method of claim 3 wherein the black liquor removed from the mixing tank and the portion of the black liquor remaining in the intermediate liquor tank are each removed to the same further evaporation stage.

5. The method of claim 1 wherein the black liquor in the mixing tank has a dry solids content below 45%.

* * * * *